US005727356A

United States Patent [19]

Ensinger et al.

[11] Patent Number: 5,727,356

[45] Date of Patent: Mar. 17, 1998

[54] COMPOSITE SECTION FOR FRAMES OF WINDOWS, DOORS, FACADE ELEMENTS AND THE LIKE

[75] Inventors: Wilfried Ensinger; Dieter Eisenhardt, both of Nufringen, Germany

[73] Assignee: Ensinger GmbH & Co., Nufringen, Germany

[21] Appl. No.: 776,086

[22] PCT Filed: Jul. 5, 1995

[86] PCT No.: PCT/EP95/02601

§ 371 Date: Mar. 18, 1997

§ 102(e) Date: Mar. 18, 1997

[87] PCT Pub. No.: WO96/04450

PCT Pub. Date: Feb. 15, 1996

[30] Foreign Application Priority Data

Aug. 4, 1994 [DE] Germany ..... 44 27 682.6

[51] Int. Cl.[6] ..... E04B 1/94; E06B 1/12; E06B 3/263

[52] U.S. Cl. ..... 52/717.02; 52/204.1; 52/204.5; 52/656.6; 52/730.3; 52/730.5; 52/730.6; 52/734.1; 49/DIG. 1

[58] Field of Search ..... 52/204.1, 204.5, 52/656.5, 656.6, 717.01, 717.02, 730.3, 730.4, 730.5, 730.6, 734.1; 49/DIG. 1

[56] References Cited

U.S. PATENT DOCUMENTS

| | | | |
|---|---|---|---|
| 3,250,663 | 5/1966 | Sharp et al. | 52/773 X |
| 4,492,063 | 1/1985 | Schock et al. | 52/656.5 X |
| 4,740,405 | 4/1988 | Tanaka et al. | 49/DIG. 2 X |
| 5,022,205 | 6/1991 | Ford | 52/730.3 X |

FOREIGN PATENT DOCUMENTS

| | | | |
|---|---|---|---|
| 729922 | 3/1966 | Canada | 49/DIG. 2 |
| 1509061 | 2/1969 | Germany . | |
| 30 35 526 | 4/1982 | Germany . | |
| 3102616 | 9/1982 | Germany . | |
| 3224001 | 12/1983 | Germany . | |
| 3301906 | 7/1984 | Germany | 52/730.5 |
| 3734947 | 4/1989 | Germany . | |
| 40 21 796 | 1/1992 | Germany . | |
| 3801564 | 8/1993 | Germany . | |
| 42 03 758 | 8/1993 | Germany . | |
| 328110 | 9/1970 | Sweden . | |

*Primary Examiner*—Carl D. Friedman
*Assistant Examiner*—Laura A. Callo
*Attorney, Agent, or Firm*—Barry R. Lipsitz

[57] ABSTRACT

A composite section for frames of windows, doors, facade elements and the like consists of two metal section parts and at least one plastic insulating web which joins these metal section parts and is held with its ends in corresponding grooves of the metal section parts. The plastic material forming the insulating web is combined with a composite fiber skeleton consisting of heat-resistant fibers. The composite fiber skeleton is anchored in a positively and/or frictionally connected manner in the grooves of the metal section parts so as to also ensure cohesion of the metal section parts when the plastic material of the insulating web degenerates. The composite fiber skeleton is at least one band with thickened edge sections which are anchored in a positively connected manner in the grooves of the metal section parts.

12 Claims, 2 Drawing Sheets

COMPOSITE SECTION FOR FRAMES OF WINDOWS, DOORS, FACADE ELEMENTS AND THE LIKE

Figure 1:
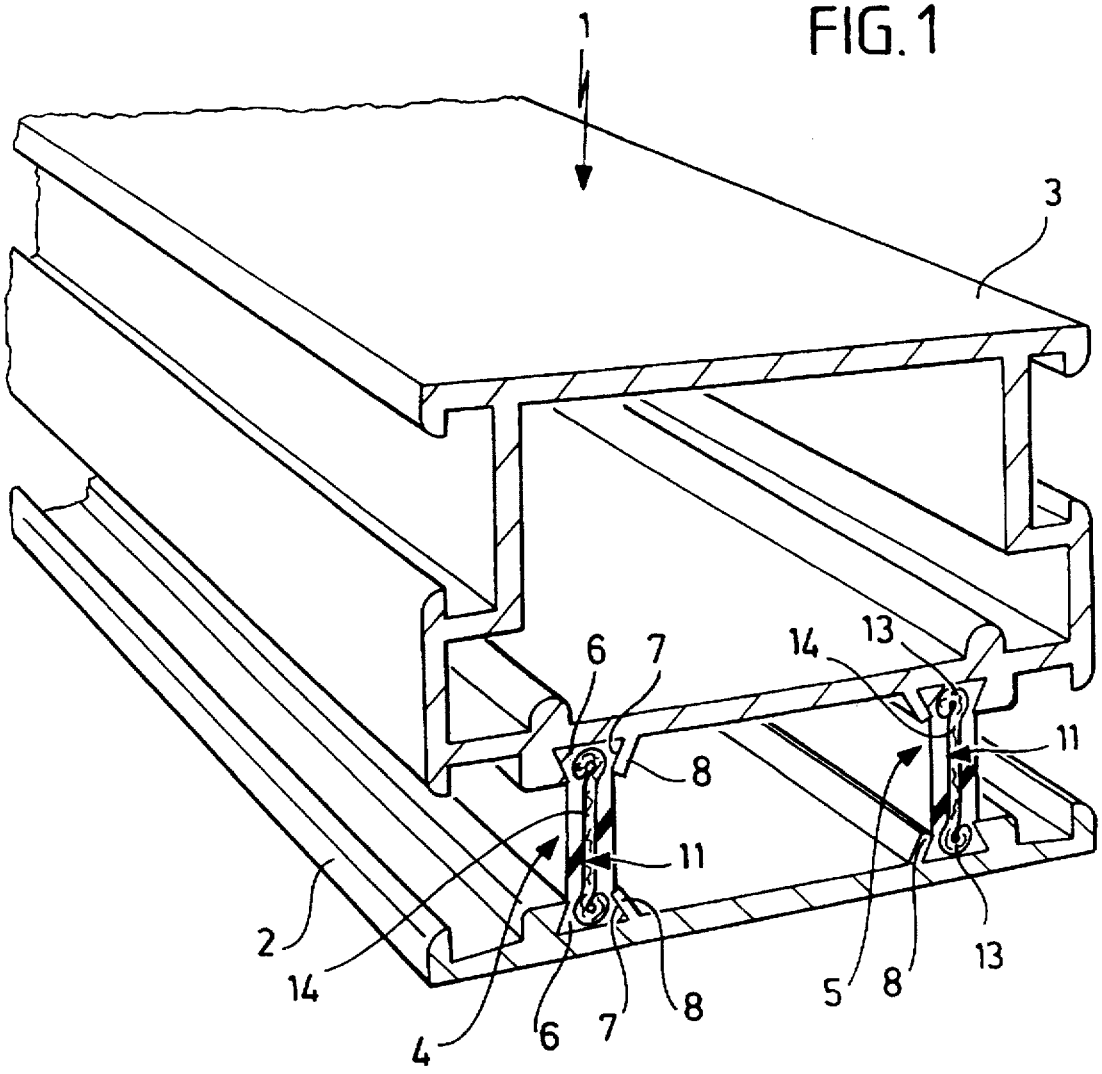

The invention relates to a composite section for frames of windows, doors, facade elements and building components.

A composite section of this kind is known from DE 31 02 616 A1.

Such a composite section is based on the following technical background: It can happen that the plastic material forming the insulating web becomes brittle or cracks, for example, due to aging or holding elements being pressed against it in a point-shaped or line-shaped manner, and the composite section falls apart on account of inability of the insulating web to hold its metal section parts together. This can prove highly dangerous. Also, as a rule, the plastic material forming the insulating web is not fireproof or heat-resistant, and so it chars, for example, in the case of fire or when welding the metal section parts. This can also destroy the cohesion of the two metal section parts. Therefore, for example, an outer metal section part which is no longer joined to the inner one can, in the case of fire, fall from the wall of a building and cause serious injury to persons and damage to property on the ground. The embedding of incombustible, but loose reinforcement fibers, for example, glass or carbon fibers, which mainly extend in one direction only and are not connected to one another, does not change this in any way, as these do not contribute to providing firm support of the one metal section part on the other when the plastic material forming the insulating web has lost its cohesion.

Therefore, provision is made in the above-mentioned publication DE 31 02 616 A1 for the plastic material forming the insulating web to be combined with a composite fiber skeleton consisting of heat-resistant fibers and for the composite fiber skeleton to be joined to the metal section parts in such a way that cohesion of the metal section parts is ensured, even when the plastic material of the insulating web degenerates, and, therefore, in particular, in the case of fire.

In this known composite section, the composite fiber skeleton consists of glass or carbon fibers which are wound in a simple way around anchoring elements provided at both ends of the insulating web, and these windings are embedded in the plastic material of the insulating web or can lie on the outer sides thereof. The manufacturing of such windings is not easy from the point of view of manufacture engineering. Furthermore, the individual windings do not hold together, which may impair the firmness of the insulating web and hence of the composite section if the plastic material forming the insulating web is damaged.

The object of the invention is to so design a generic composite section that it is simpler to manufacture and the firmness of the insulating web and hence of the composite section, in particular, also in the case of fire, is generally improved.

The object is accomplished in a generic composite section by the features contained in the characterizing clause of patent claim 1.

Owing to the design as a band, the composite fiber skeleton can be prefabricated in a simple way, and the fibers in the band can be held together by weaving, braiding, knitting or the like. The thickened edge sections of the band provide reliable anchoring at the metal section parts. Finally, the band as such provides the insulating web with better inner cohesion than loose fiber windings.

Figure 2:
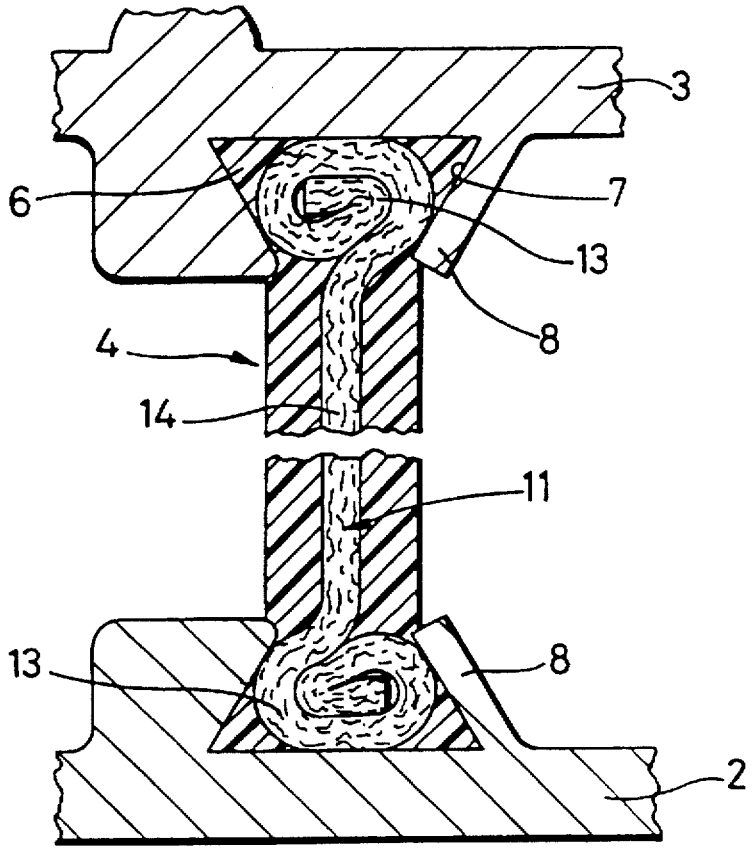
Figure 3:
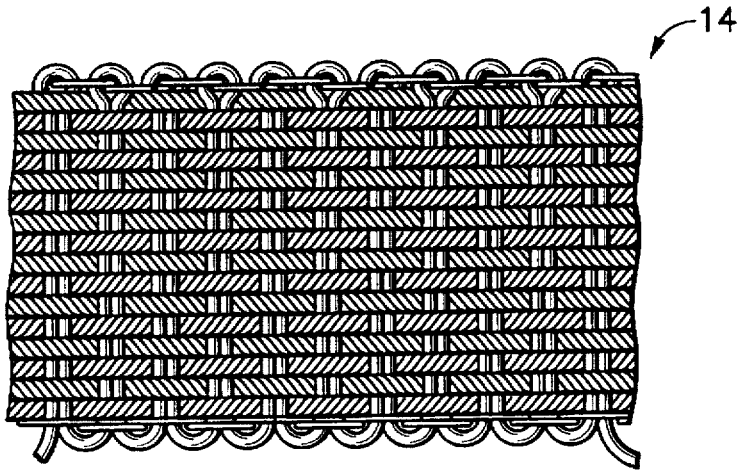

The following description of preferred embodiments of the invention serves in conjunction with the appended drawings to explain the invention in further detail. The drawings show:

FIG. 1 schematically a perspective view of a composite section for windows, doors, facade elements and the like;

FIG. 2 a broken-off part sectional view of the composite section of FIG. 1 in the area of the insulating webs thereof; and FIG. 3 a composite fiber material in the form of a woven band which can be combined as skeleton with an insulating web of the composite section according to FIG. 1.

FIG. 1 shows a composite section 1 suitable, for example, for the manufacture of windows, doors or facade elements, with an inner metal section part 2 and an outer metal section part 3 made, for example, of aluminum, aluminum alloy or steel. The two metal section parts 2, 3 are joined together by longitudinally extending insulating webs 4, 5 made of plastic, for example, polyester resin. The insulating webs 4, 5 form a heat-insulating bridge between the metal section parts 2, 3.

With their ends 6 of dovetailed cross section, the insulating webs 4, 5 project into corresponding, longitudinally extending grooves 7 of the metal section parts 2, 3 in which they are held by rolling the wall legs 8 delimiting these grooves 7 in a corresponding line-shaped or point-shaped manner, cf. also FIGS. 2 and 3.

In the illustrated embodiment of the composite section 1, two insulating webs 4, 5 are provided for joining the metal section parts 2, 3. With simpler composite section shapes, in principle, only a single insulating web is also sufficient to join the two metal section parts. Furthermore, the two insulating webs 4, 5 illustrated in FIG. 1 could also be joined together by one or several transverse webs made of the same plastic material. The following statements refer to such embodiments of composite sections and insulating webs, respectively.

As indicated in FIG. 1 and shown clearly in FIG. 2, the plastic matrix forming the insulating webs 4, 5 is combined with a composite fiber skeleton 11. The composite fiber skeleton 11 consists of firm, low heat-conducting, incombustible, fireproof, heat-resistant fibers, for example, glass fibers, carbon fibers or fibers made of heat-resistant plastic, in particular, aramide fibers or natural fibers, in particular, asbestos or hemp fibers. The inner coherence of the composite fiber skeleton is ensured by this skeleton being of woven, braided, knitted design or the like, and the fibers can be united to threads or yarns before formation of the composite skeleton. Bonded in the plastic of the insulating web 4, 5, the composite fiber skeleton 11 with its fibers extending longitudinally and transversely in the insulating web and joined to one another is capable of withstanding high compressive, shear and tensile stresses—also together with thermal loads. The embedding of the composite fiber skeleton 11 thus results in a distinct increase in the firmness of the insulating web 4, 5 and in improved securing of the composite structure in the composite section 1.

As is apparent, in particular, from FIG. 2, the composite fiber skeleton 11 has in the area of the grooves 7 of the metal section parts 2, 3 profiled, thickened ends 13 which are anchored in a positively connected manner in the grooves 7 such that they can also not come out of these when the plastic forming the insulating web 4 degenerates, for example, owing to the action of heat or crack formation, or when it is generally subjected to mechanical overloading. In this case, too, the composite fiber skeleton 11 thus also provides a cohesion and a suspended joining between the metal section parts 2, 3 and so, for example, in the case of fire, these cannot become detached from one another, but remain unreleasably attached to one another.

In the embodiment illustrated in FIG. 2, the composite fiber skeleton 11 is in the form of a woven band 14 which is completely embedded in the plastic matrix of the insulating web 4 so the plastic of the insulating web surrounds and penetrates the composite fiber skeleton 11 on all sides thereof. The profiled, thickened ends 13 are produced on the band 14, illustrated as such in FIG. 3, which forms the composite fiber skeleton 11, by the edge sections of the band being rolled-in in a bead-like manner and attached, for example, by sewing or adhesive bonding so that they form a positively connected anchoring in the grooves 7 of the metal section parts 2, 3. In the flexible, pliable band 14, illustrated in FIG. 3, which forms the raw material for the composite fiber skeleton 11, the transversely extending fibers or threads could also be oriented at an incline to the longitudinally extending fibers or threads.

The thickened ends 13 on the band 14 can also be formed in a different way, for example, by direct textile joining (weaving, knitting) of bead-shaped portions, possibly with corresponding profiling, to the edges of the band 14 or also by attaching glass fiber bundles or the like to the edges of the band.

The composite fiber skeleton 11 comprising the band 14 with the thickened edge sections 13 and consisting of heat-resistant fibers is anchored in a positively connected manner in the grooves 7 of the metal section parts 2, 3 over the entire length of the insulating webs 4, 5.

A further embodiment of a composite section differs from that according to FIG. 2 in that a composite fiber skeleton consisting of heat-resistant fibers is arranged not inside the insulating web 4, but essentially on the outside thereof, however, with the plastic matrix forming the insulating web 4 fully or partly penetrating the composite fiber skeleton. There could also be provided on each of the two outer sides of the insulating web 4 individual bands which, with ends thickened in a bead-like manner similar to the ends 13 in FIG. 2, engage the grooves 7 of the metal section parts 2, 3 and thereby provide positively connected support. The ends 13 of two individual bands 14 thickened in a bead-like manner can be produced, for example, with the aid of glass fiber bundles arranged between the bands and extending parallel to their longitudinal axis. In the case of individual bands at the sides, these can be joined to one another by fibers or threads extending transversely between them so that, so to speak, a three-dimensional, plastic-filled structure with increased stability is produced.

The plastic forming the insulating webs 4, 5 and reinforced by the composite fiber skeleton 11 may additionally contain further substances: for example, (as known per se) individual, loose reinforcement fibers, in particular, glass or carbon fibers, glass beads or also flameproof agents, preferably in powder form, in particular, antimony trioxide, aluminium hydroxide, sodium silicate, organic compounds containing chlorine, bromine, phosphorous, microfibrous dawsonites and/or blowing agents, in particular, azodicarbonamide and/or swelling agents, in particular, hollow microspheres of silicate, polypropylene or polyethylene containing blowing agent.

In particular, thermosetting plastics, for example, unsaturated polyester, phenacrylate or vinyl ester, epoxy, phenolic or urea resins as well as thermoplastic or cross-linkable plastics, for example, polyamide, polysulfone, polyetherketone resins or polyurethane are suitable for the manufacture of the insulating webs 4, 5 combined with the heat-resistant composite fiber skeletons 11.

The bands 14 can be combined with the plastic forming the insulating webs 4, 5 by, for example, pultrusion, extrusion or coextrusion.

The fiber content of the composite fiber skeleton 11 can be, for example, up to 70 percent by volume of the insulating webs 4, 5.

In general, in all embodiments described hereinabove, it is also possible to improve in a manner known per se the frictional and/or positive connection of the ends of the insulating webs 4, 5 with the metal section parts 2, 3 by additional adhesive bonding.

We claim:

1. Composite section for frame of building components comprising two metal section parts and at least one insulating web comprising plastic material and joining said metal section parts, said insulating web having ends being held in corresponding grooves of said metal section parts, the plastic material forming said insulating web being combined with a composite fiber skeleton comprising heat-resistant fibers, and said composite fiber skeleton being anchored in at least one of a positively and frictionally connected manner in said grooves of said metal section parts so as to also ensure cohesion of said metal section parts when the plastic material of said insulating web degenerates, characterized in that said composite fiber skeleton is at least one band which comprises said heat-resistant fibers and forms thickened edge sections, said edge sections being anchored in a positively connected manner in said grooves of said metal section parts.

2. Composite section as defined in claim 1, characterized in that said composite fiber skeleton is a woven, braided or knitted article.

3. Composite section as defined in claim 1, characterized in that said heat-resistant fibers of said composite fiber skeleton are glass fibers, carbon fibers or fibers comprising heat-resistant plastic material.

4. Composite section as defined in claim 3, characterized in that said fibers comprising heat-resistant plastic material are selected from aramide fibers, natural fibers, asbestos and hemp fibers.

5. Composite section as defined in claim 1, characterized in that said composite fiber skeleton is embedded in the plastic material of said insulating web.

6. Composite section as defined in claim 1, characterized in that said composite fiber skeleton is arranged at least partly on the outside of said insulating web.

7. Composite section as defined in claim 1, characterized in that the plastic material of said insulating web contains loose reinforcement fibers in addition to said band.

8. Composite section as defined in claim 7, characterized in that said loose reinforcement fibers comprise glass or carbon fibers.

9. Composite section as defined in claim 1, characterized in that the plastic material of said insulating web contains flameproof agents in addition to said band.

10. Composite section as defined in claim 9, characterized in that said flameproof agents are selected from antimony trioxide, aluminium hydroxide, sodium silicate, organic compounds containing chlorine, bromine, phosphorous, microfibrous dawsonites, blowing agents, and swelling agents.

11. Composite section as defined in claim 10, characterized in that said blowing agent comprises azodicarbonamide.

12. Composite section as defined in claim 10, characterized in that said swelling agent comprises hollow microspheres of silicate, polypropylene or polyethylene containing blowing agent.

* * * * *